United States Patent [19]

Shiflet et al.

[11] Patent Number: 4,964,927

[45] Date of Patent: Oct. 23, 1990

[54] ALUMINUM-BASED METALLIC GLASS ALLOYS

[75] Inventors: Gary J. Shiflet; S. Joseph Poon; Yi He, all of Charlottesville, Va.

[73] Assignee: University of Virginia Alumini Patents

[21] Appl. No.: 330,891

[22] Filed: Mar. 31, 1989

[51] Int. Cl.[5] ..... C22C 21/00

[52] U.S. Cl. ..... 148/403; 420/528; 420/550; 420/551; 420/552

[58] Field of Search ..... 148/403; 420/528, 550–551, 420/552

[56] References Cited

PUBLICATIONS

Inoue et al., "New Amorphous Alloys with Good Ductility in Al—Ce—M (M=Nb, Fe, Co, Ni or Cu) Systems", Japanese Journal of Applied Physics, 27:L1796–L1799, (Japan, Oct. 1988).

*Primary Examiner*—Richard O. Dean

[57] ABSTRACT

Ductile, strong, and stable (crystallization temperature above 250° C.) Al-X-Z metallic classes contain 90 at. % Al where X-Fe, Co, Ni, Rh; Z-rare earths, Hf, Y, Stable (crystallization temperatures reaching 500° C.) Al-Y-Fe-Si glasses have superior hardness properties upon consolidation. The present alloys are at least twice as strong in tensile strength as the strongest commercial aluminum alloys.

6 Claims, 2 Drawing Sheets

ALUMINUM-BASED METALLIC GLASS ALLOYS

BACKGROUND OF THE INVENTION

This invention relates to advanced materials technology and especially to metallic glasses.

Metallic glasses, a class of amorphous alloys made by rapid solidification, have been studied quite extensively for almost thirty years. It has been recognized for a long time that metallic glasses are usually very strong and ductile, and exhibit high corrosion resistance relative to crystalline alloys with the same compositions.

Discussion of mechanical applications of metallic glasses can be found in "*Amorphous Metallic Alloys*", edited by F. E. Luborsky (Butterworths, Boston, 1983). Chief applications are in high-strength composites and reinforced materials. For many cases, it is desirable to apply high-strength low-density metallic alloys, such as metallic glasses based on aluminum. To date, attempts to produce ductile and/or thermally stable glassy aluminum alloys have failed.

The prior art has resulted in failures in applying high-strength low-density materials and producing ductile, strong, and/or thermally stable glassy aluminum alloys.

A preferred metallic glass aluminum based alloy has the formula $Al_{85\text{-}90}(X,Z)_{15\text{-}10}$ where X=Fe, Co, Ni, Rh and Z=rare earths, Hf and Y. The alloys are formed by arc-melting the elements in an argon atmosphere and forming the melt in a helium atmosphere and rapidly cooling the alloy to produce a single-phase amorphous aluminum rich alloy with high flexibility and high strength.

The preferred alloy has the formula $Al_{90}$, $Fe_5$, $Ce_5$ having a tensile fracture strength of 940 MPa.

One alloy the invention has the formula $Al_{87}$ $Fe_{8.7}$ $Gd_{4.3}$, and has a tensile fracture strength which exceeds 800 MPa.

Another preferred alloy of the invention has the formula $Al_{87}$ $Ni_{8.7}$ $Y_{4.3}$ and has a tensile fracture strength of greater than 800 MPa.

Preferred alloys have the formula $Al_{87\text{-}90}$ $(a_{1-x}b_x)_{10\text{-}13}$, where $0.3<X<0.7$; where a=Fe; and where b=Y, La, Ce, Sm, Gd, Lu, Hf.

Preferably the alloy is prepared with a formula $Al_{87}$ $Fe_{8.7}$ $b_{4.3}$.

The preferred method for forming a ductile strong thermally stable glassy aluminum alloy comprises arc-melting nominal amounts of elements in the formula $Al_{87\text{-}90}(a_{1-x}b_x)_{10\text{-}13}$, where a=Fe, Co, Ni, Rh and b=rare earths Hf, Y.

DESCRIPTION OF THE INVENTION

Ductile, strong, and stable (crystallization temperature above 250° C.) Al-X-Z metallic classes contain 90 at. % Al where X-Fe, Co, Ni, Rh; Z-rare earths, Hf, Y Stable (crystallization temperatures reaching 500° C.) Al-Y-Fe-Si glasses have superior hardness properties upon consolidation. The present alloys are at least twice as strong in tensile strength as the strongest commercial aluminum alloys.

The mechanical properties (i.e., tensile fracture strength and Young's modulus) of eight different alloys of a new class of metallic glasses containing up to 90 at. % aluminum are described along with crystallization temperatures of these alloys. One $Al_{90}Fe_5Ce_5$ material has a tensile fracture strength of 940 MPa (1 MPa=145 psi). Two others ($Al_{87}Fe_{8.7}Gd_{4.3}$ and $Al_{87}Ni_{8.7}Y_{4.3}$) exceed 800 MPa. Young's modulus measurements for three of these exceed 60 GPa with a high value of 66 GPa for the $Al_{90}Fe_5Ce_5$ glass. These unusually high strengths of the aluminum glasses can be of significant importance in obtaining high-strength, low-density materials. Subscripts in this paragraph are in atomic %.

In exploring the possibilities of synthesizing very aluminum-rich icosahedral quasicrystals in the $Al_{20}Cr_2Ce$-type alloys ($Al_{18}Cr_2Mg_3$ structure, 184 atoms per unit cell), a new metallic glass (we refer to amorphous alloys obtained by rapid solidification) of composition $Al_{87}Fe_{8.7}Ce_{4.3}$ was discovered. This breakthrough in fabricating melt-spun single-phase amorphous aluminum-rich alloys with high flexibility led to a search for metallic glasses containing up to 90 at. % Al. Thus far, amorphous systems produced in our group include $Al_{90}$ $(a_{1-x}b_x)_{10}$ and $Al_{87}$ $(a_{1-x}b_x)_{13}$, where $0.3<X<0.7$; a=Fe; b=Y, La, Ce, Sm, Gd, Lu, and Hf; $Al_{87}Co_{8.7}Ce_{4.3}$, $AL_{87}Ni_{8.7}Ce_{4.3}$, $Al_{87}Rh_{8.7}Ce_{4.3}$, $Al_{87}Co_{8.7}Y_{4.3}$, $Al_{87}Co_{8.7}Hf_{4.3}$, $Al_{87}Ni_{8.7}Y_{4.3}$, and $Al_{87}Ni_{6.7}Hf_{6.3}$. These alloys were prepared by melting nominal amounts of elements in an argon atmosphere. Melt spinning was carried out in a partial helium atmosphere using a 20-cm-diam copper wheel with a typical circumferential velocity of 40 m/s. Samples with compositions listed above were found to form single-phase metallic glasses. Their typical dimensions were 15 μm thick, 1–2 mm wide, and up to several meters long. The melt-spun ribbons were very flexible and could easily be bent in half without fracturing.

This unexpected finding of single-phase aluminum-rich glassy alloys produced in continuous ribbons has led to the synthesis of many more metallic glasses containing up to 90 atomic percent (at. %) aluminum.

The existence of amorphous metallic ribbons containing as much as 90 at. % aluminum has both scientific and technological implications. First of all, the unusual formability of these glassy phases is noted. For binary alloys of composition $a_{100-x}b_x$, it is generally observed that metallic glasses can only be formed when $85>x>15$. In alloys containing more than two components, this result can be generalized. It is believed that this fact is related to the existence of a low eutectic region coinciding with the glass formation range. The eutectic region is favorable for the formation of metallic glasses because the liquid is stable to a lower temperature in this region than in other regions of the phase diagram. In principle, the degree of supercooling required to form a glass is reduced and crystallization is suppressed, thus rendering the formation of metallic glass possible.

Quite different from the usual glass-forming systems, the liquidus temperatures of the related aluminum binary alloys herein either increase or change little as the minority components are added to aluminum. Knowing these facts, one can say that the formation of glassy alloys based on 90 at. % aluminum is unique because there does not seem to be additional stability in the aluminum melt due to alloying. It should also be pointed out that the synthesis of amorphous aluminum is in itself a major challenge in materials physics. Although most simple metals and transition metals, when included with various amounts of gaseous impurities, can form amorphous phases easily as they are quench condensed onto cryogenic substrates, the formation of amorphous aluminum (or very aluminum-rich alloys) by quench condensation, which has a much higher cooling rate than rapid solidification, has not been observed. On the other hand, there were reports of amorphous aluminum alloys containing 70 to 80 at. % aluminum synthesized by ion beam mixing, ion implantation, and rapid solidification. The glassy samples were found to be brittle. In addition to their scientific novelty, the present alloys could have technological importance, especially in applications requiring high-strength low-density materials. This technological impact is expected, particularly in view of the well-established techniques in mass-producing metallic glass ribbons.

With the formation of Al-Fe-Ce glassy alloys as the basis for obtaining other aluminum glasses, several dozen compositions were studied by replacing Fe with Co, Ni, and Rh; and Ce with other lanthanides, Y, and Hf in Al-Fe-Ce.

The specimens used in one example were $Al_xFe_2Gd$ where x ranged from 40 to 15, corresponding to 93 to 83.3 at. % Al, and $Al_xFeGd$ with x from 18 to 11.3, corresponding to 90 to 85 at % Al. Alloys with the above Fe to Gd atomic percent ratios were selected because we wanted to investigate the near-eutectic regions between aluminum and the compounds $Al_{10}Fe_2Gd$ ($Mn_{12}Th$ structure) and $Al_2(Fe,Gd)$ ($Zn_2Mg$ structure).

TABLE 1

Thermodynamic Data of Al—Fe—Gd Metallic Glasses Obtained from DSC

| Alloy | $T_x$(°C.) | $T_e$(°C.) | $T_l$(°C.) | $\Delta H_x \left(\frac{kJ}{mol}\right)$ | $\Delta H_m \left(\frac{kJ}{mol}\right)$ |
|---|---|---|---|---|---|
| $Al_{40}Fe_2Gd$ | 366 | 649 | 659 | −3.25 | 8.59 |
| $Al_{30}Fe_2Gd$ | 374 | 647 | 659 | −4.15 | 7.09 |
| $Al_{26}Fe_3Gd$ | 383 | 648 | 658 | −4.75 | 6.29 |
| $Al_{20}Fe_2Gd$ | 373 | 638 | 647 | −5.87 | 6.01 |
| $Al_{17}Fe_2Gd$ | 331 | 636 | 653 | −5.48 | 4.72 |
| $Al_{16}Fe_2Gd$ | 346 | 648 | 657 | −4.54 | 3.21 |
| $Al_{18}FeGd$ | 371 | 638 | 650 | −4.25 | 7.84 |
| $Al_{16}FeGd$ | 365 | 638 | 650 | −4.62 | 6.70 |
| $Al_{13.3}FeGd$ | 369 | 637 | 649 | −4.80 | 8.52 |
| $Al_{11.3}FeGd$ | 340 | 637 | 647 | −4.97 | 4.38 |

Compositions of alloys studied are listed in Table 1. The alloy ingots were prepared by melting nominal amounts of high purity elements in an arc furnace under an argon atmosphere. Rapidly solidified samples in ribbon form were obtained by using a single roller melt spinner in a partial helium atmosphere. Typical circumferential speed of the copper wheel is 45 meters per second. The sample dimensions were 1–2 mm wide, 15–20 μm thick, and up to several meters long.

Samples for heat treatment were sealed in evacuated pyrex tubes or quartz tubes. All isothermal annealing was performed at the desired temperatures for several minutes. Both as-quenched and annealed sampled were examined by a Siemens X-ray diffractometer with Cu Kα radiation.

Differential scanning calorimetry (DSC) experiments were carried out by using a Perkin-Elmer DSC 7 system. The scanning range is from 40° C. to 680° C.. DSC specimens were cut from the melt-spun ribbons, and the typical weight of the specimens is 8 mg. Graphite pan was used as sample container and about 9 mg Cu with 99.999% purity was used as the reference material. DSC scanning rate was 20° C. per minute.

Three samples, of compositions $Al_{40}Fe_2Gd$, $Al_{30}Fe_2Gd$ and $Al_{18}FeGd$, where aluminum contents exceeded 90 atomic percent, were found to contain a trace of aluminum in the amorphous hosts. All other samples were confirmed to be amorphous, without detectable trace of crystalline phases. Transmission electron microscopy further confirmed that no crystalline inclusions were present in the samples. At high aluminum content the melt-spun ribbons were very ductile and flexible, while reducing aluminum to lower than 85 atomic percent made the ribbons become brittle.

DETAILED DESCRIPTION OF THE DRAWINGS

Figure 1:
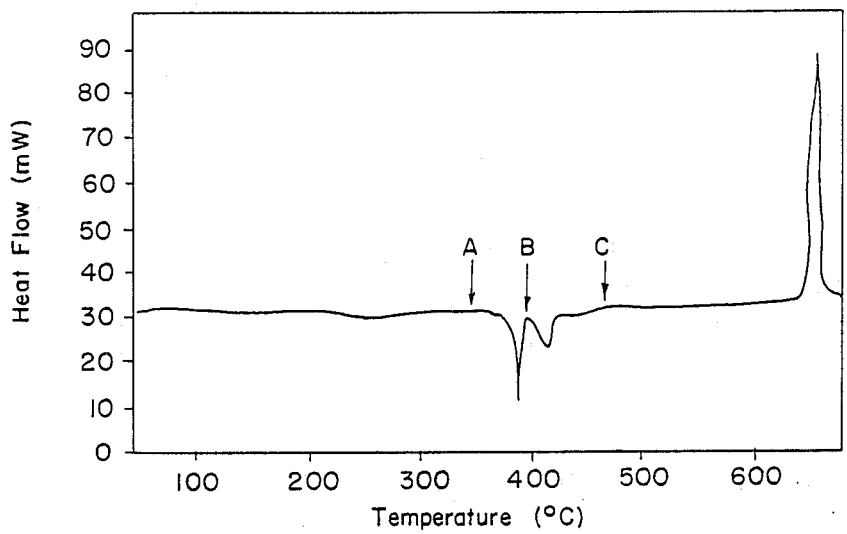
FIG. 1 shows a DSC trace for $Al_{25}Fe_2Gd$ metallic glass.
Figure 2:
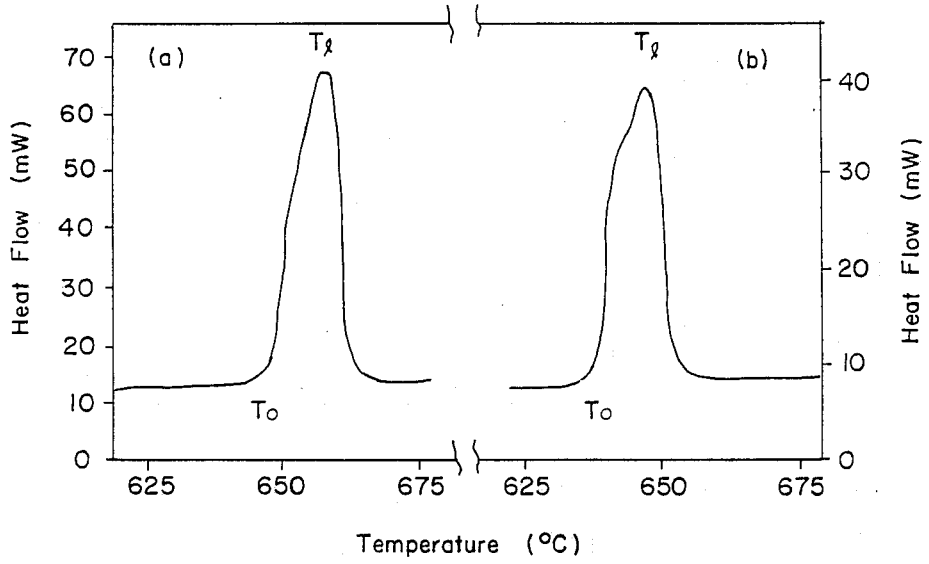
FIG. 2 shows the solid-to-liquid transformation peaks of: (a) $Al_{25}Fe_2Gd$ and (b) $Al_{17}Fe_2Gd$ alloys.
Figure 3:
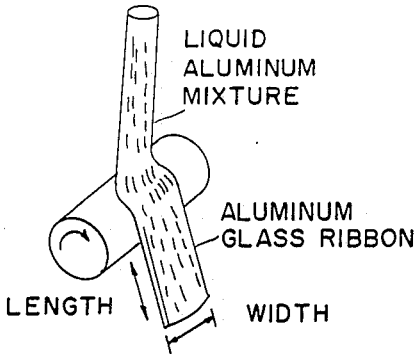
FIG. 3 schematically shows the making of an aluminum glass ribbon.
Figure 4:
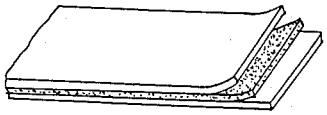
FIG. 4 shows aluminum glass layered between other materials.
Figure 5:
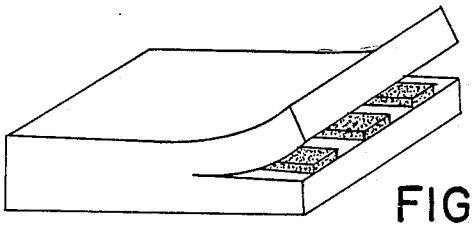
FIG. 5 shows ribbons aligned within layers of material.
Figure 6:
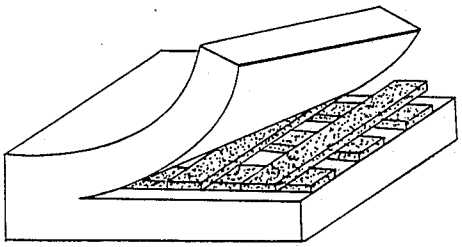
FIG. 6 shows ribbons of aluminum glass crossed between layers of material.
Figure 7:
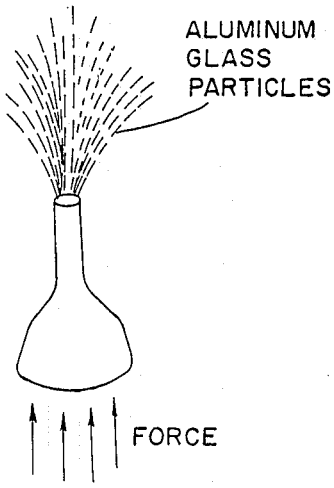
FIG. 7 shows the atomization of aluminum glass particles to give a hard product.
Figure 8:
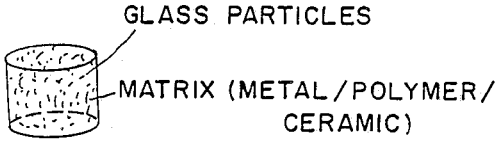
FIG. 8 is an example of a hot pressed product made of the aluminum glass particles.
Figure 9:
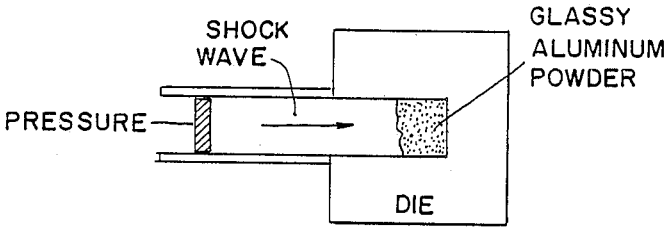
FIG. 9 is an example of shaping glassy aluminum powder.

FIG. 1 shows a differential scanning calorimetry trace for amorphous $Al_{26}Fe_2Gd$. Four exothermic peaks can be seen. The first exothermic peak, at 245° C., is associated with the primary crystallization of aluminum. As-quenched ribbons were also annealed for five minutes at the temperature indicated by point A. The X-ray diffraction pattern showed only aluminum peaks and an amorphous background. The volume fraction of aluminum is estimated to be about 30%. The second exothermic peak at 387° C., which is much sharper, is associated with the crystallization of the remaining glassy matrix. The amorphous sample annealed at point B was found to contain mainly f.c.c. Al and the $Al_{10}Fe_2Gd$ phase, as well as a trace amount of the $Al_2$ (Fe, Gd) phase (of the $Cu_2Mg$ structure in this case). The majority phases were also formed upon crystallizing the other $Al_xFe_2Gd$ glasses. The sample annealed at point C contained the same phases as those at point B. Therefore, the third exothermic peak may be related to some yet unknown changes in the microstructure. Finally, the endothermic peak at 658° C. represents solid-to-liquid transformation. The latter is also confirmed by direct observation of the sample melting while encapsulated in a pyrex tube. Careful examination of the peak shapes reveals that it is actually composed of two sub-peaks, as shown in FIGS. 2(*a*) and 2(*b*). This suggests that melting takes place through two steps. First, the "eutectic" melting takes place at the onset temperature denoted T. At a slightly higher temperature, the sample melts completely. This temperature, denoted $T_1$, is the liquidus temperature. It should be mentioned that eutectic solidification is also observed in the binary systems $Al_2$-Gd and Al-Fe. All other samples show essentially similar DSC profiles. Upon complete crystallization, aluminum and the $Al_2$ (Fe,Gd) phase are formed in the $Al_xFeGd$ alloys. For $Al_{40}Fe_2Gd$, $Al_{30}Fe_2Gd$ and $Al_{18}FeGd$ where aluminum concentration exceeds 90 at. %, the primary crystallization of Al occurs at a lower temperature and extends over a wider temperature range. On the other hand, reducing Al concentration to 85 at. % and below, primary crystallization of Al is no longer observed.

Thermodynamic data obtained from DSC scans are listed in Table 1. $T_x$ is the onset temperature where the sample completely transforms to crystalline phases, corresponding to the onset of the second exothermic peak in FIG. 1. $H_x$ is the change of enthalpy between the initial amorphous state and the final crystallized state prior to melting, which is the integral of all exothermic peaks. $H_m$ is the melting enthalpy.

It is generally observed that for binary alloys of composition $A_{100-x}B_x$, metallic glasses can only be formed when $85>x>15$. In alloys containing more than two components, this result can be generalized. It is believed that this fact is related to the existence of a low eutectic region coinciding with the glass formation range. The eutectic region is favorable for the formation of metallic glasses because the liquid is stable to a lower temperature there than in other regions of the phase diagram. In principle, the degree of supercooling required to form a glass is reduced and crystallization is suppressed, thus rendering the formation of metallic glass possible. Quite different from the usual glass forming systems, the liquidus temperatures of the related ternary alloys reported here change little as the minority components are added to aluminum, as can be seen in Table 1, where $T_l$ is only about 2° to 14° C. lower than the melting point of pure Al. Knowing these facts, one can say that the formation of Al-rich metallic glasses is unique because there does not seem to be additional stability in the aluminum melt due to alloying.

The reduced glass temperatures $T_{rg}$ can be estimated if we take $T_x$ as the lower bound of $T_g$, which is the glass temperature. Then, $T_{rg} \approx T_x/T_l$ is from 0.65 to 0.70 in our case, which are among the highest $T_{rg}$ values of metallic glasses. Thus, the high values of $T_{rg}$ in Al-Fe-Gd glasses account for the easy glass formability in these Al-rich ternary alloys. However, it is not yet understood why $T_{rg}$ is high in this system.

We have studied the formation and stability of Al-based metallic glasses in Al-Fe-Gd system by means of X-ray diffraction and DSC measurements. It is shown that the liquidus temperatures of all samples are only several degrees lower than that of pure aluminum and no deep eutectic region exists. Combined with the fact that the reduced glass temperatures $T_{rg}$ are high, one concludes that the formation of metallic glasses in this ternary system is unique.

I claim:

1. A metallic glass aluminum based alloy of the formula $Al_{85-90}(X,Z)_{15-10}$ where X=Fe, Co, Ni, Rh and Z=rare earths, and Hf, wherein the alloys are formed by arc-melting the elements in an argon atmosphere and forming the melt in a helium atmosphere and rapidly cooling the alloy to produce a single-phase amorphous aluminum rich alloy with high flexibility and high strength.

2. The alloy of claim 1, having the formula $Al_{90}$, $Fe_5$, $Ce_5$ having a tensile fracture strength of 940 MPa.

3. The alloy of claim 1, having the formula $Al_{87}Fe_{8.7}Gd_{4.3}$, having a tensile fracture strength which exceeds 800 MPa.

4. The alloy of claim 1, having the formula $Al_{87-90}(a_{1-x}B_x)_{10-13}$, where $0.3<X<0.7$; where a=Fe; and where b=Y, La, Ce, Sm, Gd, Lu, Hf.

5. The alloy of claim 4, when the alloy is prepared with a formula $Al_{87}Fe_{8.7}B_{4.3}$.

6. The method for forming a ductile strong thermally stable glassy aluminum alloy comprising arc-melting nominal amounts of elements in the formula $Al_{87-90}(a_{1-x}b_x)_{10-13}$, where a=Fe, Co, Ni, Rh and b=rare earths and Hf.

* * * * *